United States Patent [19]

Brinker et al.

[11] 4,261,790

[45] Apr. 14, 1981

[54] APPARATUS FOR STRIPPING FILTER PAPER FROM FILTER ROD

[75] Inventors: Reiner G. Brinker, Mechanicsville; W. Charles Hamilton, Midlothian, both of Va.

[73] Assignee: Philip Morris Incorporated, New York, N.Y.

[21] Appl. No.: 68,671

[22] Filed: Aug. 22, 1979

[51] Int. Cl.[3] ..... B32B 31/18

[52] U.S. Cl. ..... 156/584; 30/90.1; 30/90.4; 30/90.8; 30/90.9; 131/33; 156/247; 156/248; 156/344; 264/139; 264/146

[58] Field of Search ..... 156/149, 244.12, 244.13, 156/244.18, 244.19, 244.24, 247, 248, 255, 257, 259, 268, 344, 522, 584; 131/10 R, 15 R, 27 R, 27 A, 33, 40, 65, 82, 84 B; 30/90.1, 90.4, 90.8, 90.9; 264/139, 141, 146, 161, 103, 566, 568, 571

[56] References Cited

U.S. PATENT DOCUMENTS

| | | | |
|---|---|---|---|
| 2,894,868 | 7/1959 | Hyde | 156/344 |
| 3,352,736 | 11/1967 | Kulwicki | 156/247 |
| 3,883,384 | 5/1975 | Hopkins | 156/244.13 |

FOREIGN PATENT DOCUMENTS

| | | | |
|---|---|---|---|
| 51-1070277 | 6/1976 | Japan | 156/584 |

*Primary Examiner*—Caleb Weston

*Attorney, Agent, or Firm*—Watson, Leavenworth, Kelton & Taggart

[57] ABSTRACT

The sheath covering of a composite structured article is removed from the filler it encircles by slitting the sheath longitudinally at plural locations, the sheath thereafter being vacuum drawn away from the filler for discard while the filler is advanced to a collection operation.

5 Claims, 3 Drawing Figures

APPARATUS FOR STRIPPING FILTER PAPER FROM FILTER ROD

BACKGROUND OF THE INVENTION

In manufacturing filter type cigarettes, the filter material rod which ultimately provides the cigarette filter component generally is manufactured in a continuous operation involving the wrapping of a cohesive mass of filter material such as cellulose acetate fibers in a paper wrapping or filler confining sheath, the rod being manufactured as indicated on a continuous basis with the continuous rod subsequently being sectioned into finite lengths for employment in the cigarette making machines. Where as can, from time to time, occur such filter rod has been defectively manufactured and it is desired to reclaim the cellulose acetate filler material, it is necessary to remove the wrapping material therefrom. To do so can be a difficult operation particularly if damage to the filter material filler is to be avoided. It is also known to form a rod of filter material by encasing the cellulose acetate fibers within the paper wrapper but subsequently to remove the wrapper following the setting up or curing of the triacetin plasticizer which is employed to bond the cellulose acetate fibers at points of crossing to thereby produce a generally cylindrically shaped cohesive mass of cellulose acetate filter material. This procedure is employed in the manufacture of filter, cigarettes which are to be provided with dilution air intake capability in the region of the filter and it is desirable to lessen the resistance to ventilation air inflow by eliminating the filter wrap material as a barrier to such ventilation inflow.

SUMMARY OF THE INVENTION

The present invention is concerned with a method and apparatus for stripping filter paper wrapping or a filter paper sheath covering from its embrace about a cohesive mass of a filler material such as cellulose acetate fibers. The invention is concerned in particular with the removal of the sheath covering from a continuous stream of the composite article of which the filter rod is constituted and can be employed for removing the sheath covering from a continuous rod as such or from a continuous stream comprised of an end-on-end aligned continuous flow of finite length filter rod sections, it thus being noted that "continuous stream" is inclusive of both an actual continuous component and a continuous stream of finite lengths of such components.

In accordance with the invention, the composite article is advanced along a fixed longitudinal course and while so transiting such course the sheath covering thereof is slit at a plurality of circularly spaced locations thereon to sub-divide the sheath covering into a corresponding plurality of sheath segments. Following the slitting of the sheath covering, the advancing article is subjected to a suction force applied to the sheath components at a location downstream of the point of slitting so that such suction force may be employed to draw the sheath segments laterally away from the filler mass to therewith separate or segregate the sheath covering from the filler, while the filler is maintained in its advancing course along the fixed longitudinal axis. The removed sheath covering segments and the separated filler can then be collected for disposal and/or further intended processing therewith.

To advance the continuous stream of composite article particularly where the continuous stream is made up of an end-on-end aligned stream of finite length filter rod sections, an "Aphis" gun of known construction can be employed, such gun functioning in the fashion of a revolver to shoot by compressed air the individual sections into the longitudinal course in alignment with preceding ones of such sections to propel such preceding sections down the processing line. Suitable support enclosure in the form of a tube is also employed to direct the stream in the desired longitudinal advance.

For the purposes of providing the suction force to remove the sheath segments following slitting, a pair of rotary wheels having concave faces and being so positioned and arranged to define a nip therebetween are employed, the slit composite rod passing through the nip at which the suction force is applied to the sheath segments so as to start the draw off of these segments from the filler. As the article advances downstream of the nip of the rotary wheels, the sheath segments are drawn away on the rotary wheels to locations laterally spaced from the advance course and are collected by a suitable vacuum operated system whereas, the composite filler in cohesive form is advanced along the article travel course into a catch tube and subsequently is collected for further processing, e.g., delivery as filter component stock to the cigarette making machines.

To provide that the suction used to draw the sheath segments away from the composite article functions only for the minimum time required to physically displace the sheath segments from the travel axis to a position clear of the filler, the rotary wheels which are provided with a series of openings in the concave base thereof and companion passageways passes over a support member connected with a source of vacuum so that a vacuum suction is communicated to the passages and wheel face openings from the location of the nip between the rotary wheels and for some rotary travel of each opening a distance from the nip up to slightly less than one-quarter of revolution of the rotary wheel. Following the release of the effect of the vacuum, an air blast can be provided to blow the sheath segments away from the face of the rotary wheel to therewith facilitate the collection of same.

The invention accordingly comprises features of construction, combination of elements, arrangement of parts and steps of assembly which will be exemplified in the construction and the method and apparatus hereinafter set forth in the scope of the invention will be indicated in the claims.

BRIEF DESCRIPTION OF THE DRAWINGS

A fuller understanding of the nature and objects of the invention will be had from the following detailed description taken in conjunction with the accompanying drawings in which.

Throughout the following description, like numerals are used to denote like parts in the drawings.

DESCRIPTION OF THE PREFERRED EMBODIMENTS

The present invention is described herein in terms of its applicability for the removal of a sheath covering from a continuous stream of cigarette filter rod material. However, it will be appreciated that it is equally applicable to utilization in connection with the removal of a sheath covering from a composite rod structure of a wide range of character.

Figure 1:
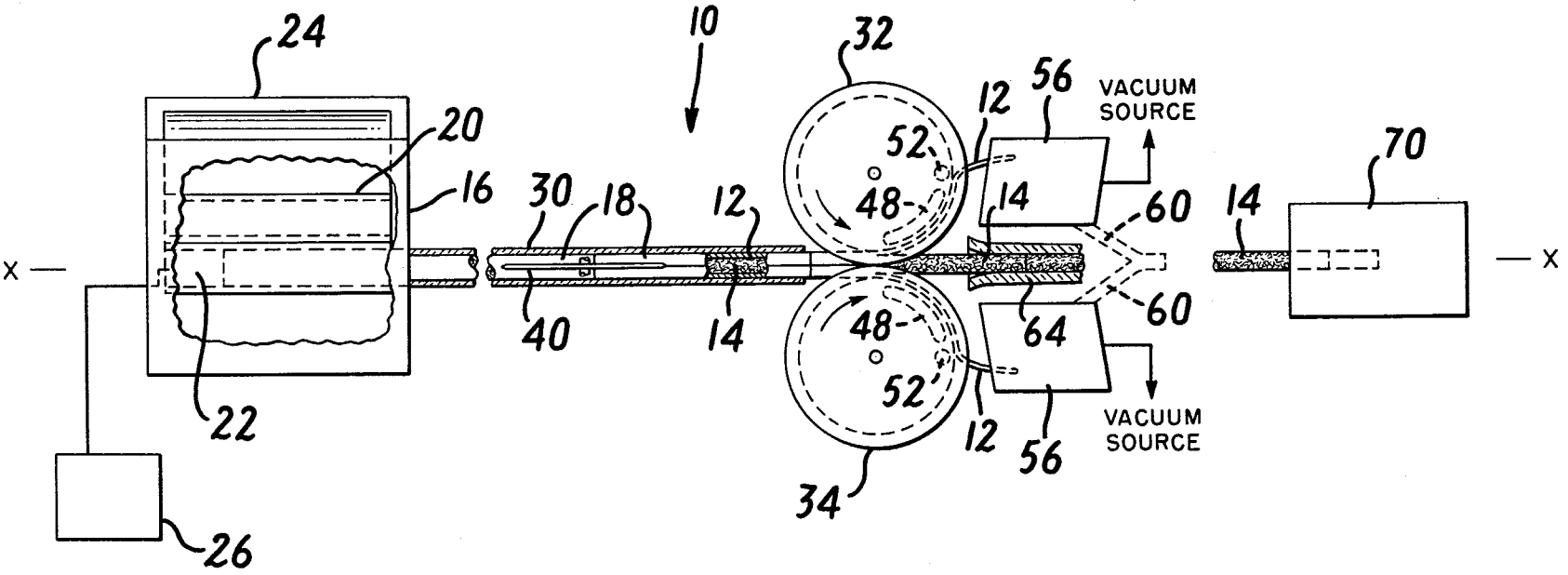
FIG. 1 is a top plan view partly in section of a system employed for removing the sheath covering from filter rod sections in accordance with the principles of the present invention.
Figure 2:
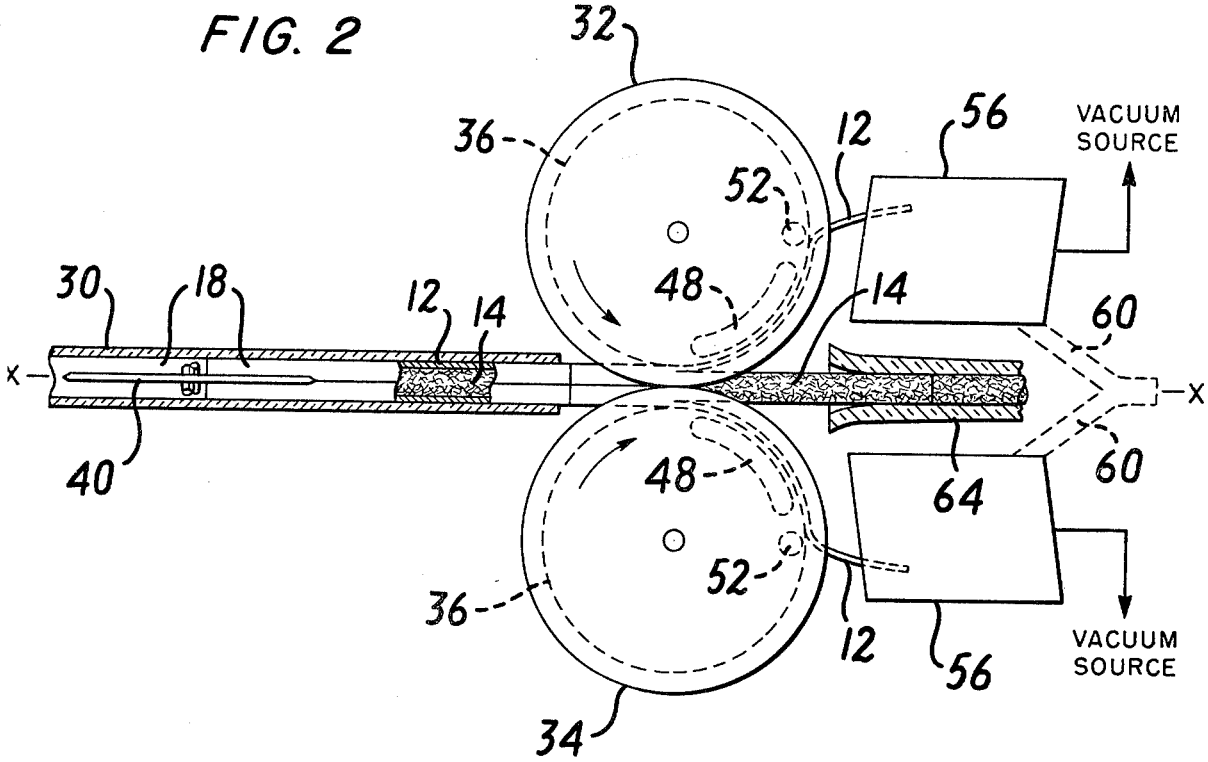
FIG. 2 is a top plan view partly in section of the slitting and sheath covering removal components of the apparatus depicted in FIG. 1.
Figure 3:
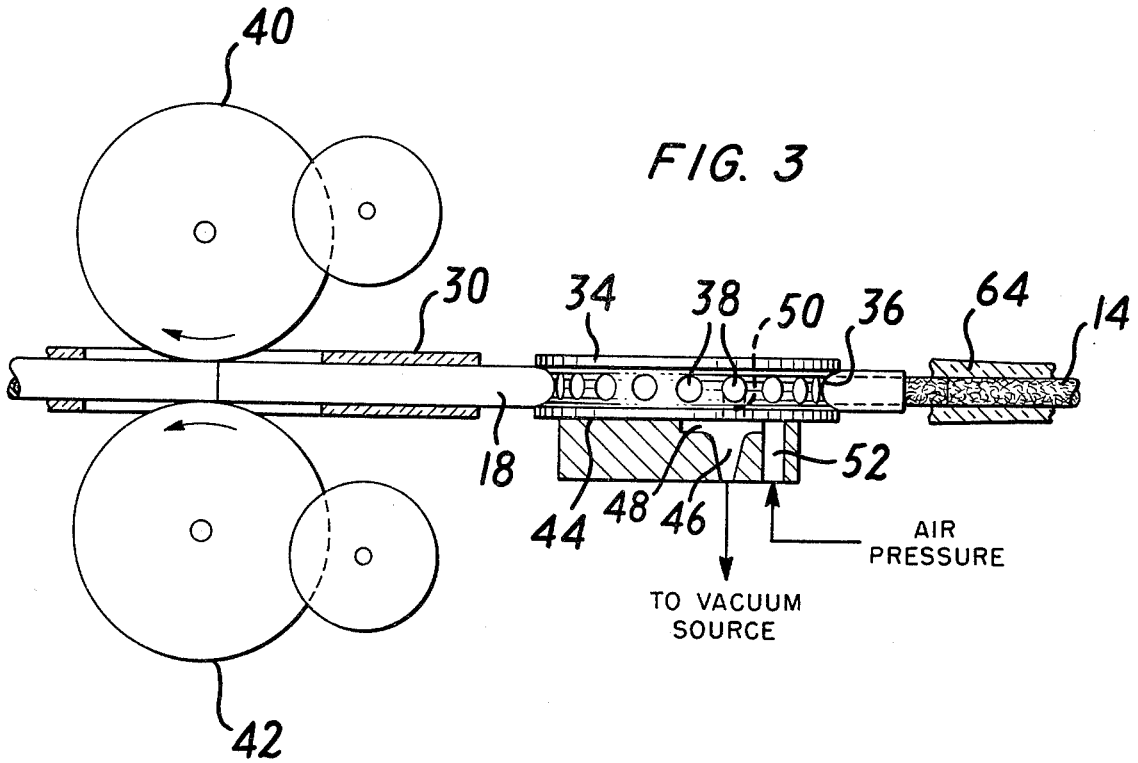
FIG. 3 is a side elevational view of FIG. 2.

Referring now to FIGS. 1–3, there is depicted therein the apparatus 10 of the present invention and which is employed for removing the paper wrapper sheath covering 12 from a composite structured continuous stream of filter rod material so as to expose and thereby permit recovery of the filler material 14, i.e., the cellulose acetate component of the filter rod. The apparatus 10 includes means shown generally at 16 with which a continuous feed of filter rod sections 18 of finite length can be fed in an in-line fashion along a predetermined longitudinal axis X—X, the feed unit 16 being of known construction and identified in the cigarette industry as a "Aphis gun". The Aphis gun 16 includes a revolving chamber 20 provided with a plurality of Bored passages 22 in the fashion of the cylinder of a revolver and to which are fed from a suitable source 24, the stock of finite length sections 18 of filter material which are to be fed into the processing line. The respective individual sections 18 are propelled from the respective bored passages of the revolving cylinder by means of air under pressure taken from a suitable source such as 26. To support the in-line stream flow of filter component members, and also to support a continuous filter rod structure if same or being treated in accordance with the invention, there is provided a support tube 30 which extends from the feed unit 16 coaxially of the fixed longitudinal axis and has its terminus disposed just adjacent the nip between a pair of rotary rollers 32 and 34.

The rotary rollers 32 and 34 which are supported for rotation about fixed, spaced apart vertical axes symmetrical of the fixed longitudinal travel course C-X of the filter rod stream are each provided with concave shaped faces 36 in correspondence to the generally cylindrically shaped contour of the filter rod segments, the faces being provided with a series of circularly spaced face openings 38. The purpose of passing the filter rod through the nip of the rotary rollers is to draw the segments into which the sheath covering of the composite article have been slit by means of the rotary cutter units 40 and 42 laterally of the longitudinal axis of travel of the composite article so that the same can be fully removed from their embracing course about the filler 14 of the article and collected for disposal. To effect the draw away, a vacuum force is applied to the surfaces of the sheath segments and to such end, the rotary rollers 32, 34 are mounted on top of supporting surfaces 44 which are provided with a passageway 46 opening at the top into an arcuate shaped aperture 48 extending from the nip of the rotary rollers for some distance of rotary travel of each face opening beyond the nip. The face openings of course are each associated with and communicated by respective passages 50 formed in the wheel with such passages outletting at the bottom face of the rotary wheels in direct communication with the vacuum passage 46 in support surface 44. Thus, a vacuum is maintained at the face of the rotary wheels and since the sheath covering is in contact with the face surfaces of the rotary wheels, the sheath segments are drawn away as the wheels rotate.

After the rotary wheels 32, 34 have rotated a certain distance beyond the nip, the vacuum force holding the sheath segments to the faces of the wheels is released and immediately thereafter at the locations best seen in FIG. 1, a blast of air under pressure is delivered through conduit 52 and into the passages 50 in the wheels to blow the sheath segments away from the wheel faces and into the region of a zone of reduced pressure as represented by collector housings 56, each of which is connected with a source of vacuum so that the sheath segments are drawn into the collectors and can be passed therefrom down through suitable conduits 60 to a point of disposal, the conduits 60 also being maintained under effect of vacuum. After the passage of the composite filter articles through the rotary wheel nip, the filler 14 is maintained in its travel along the fixed longitudinal course and shortly after passing beyond the nip enters the bell-shaped mouth of a catch tube 64 so that the stream of shaped fillers can be transported rightwardly for ultimate collection as in a collection bin 70. As will be noted particularly in FIG. 1, the catch tube is spaced closely adjacent the nip of the rotary wheels on the downstream side thereof so that the filler members will bridge from the nip beyond the entry mouth of the catch tube to ensure continuous longitudinal travel of the stream of filter components without any hazzard of same being misdirected either leftwardly or rightwardly in a fashion as would cause a jam and disruption in the operation of the apparatus.

If for any reason the sheath covering is so firmly adhered to the filler as to not be readily removable under the influence of vacuum, the entire length of article will be drawn to one side by the force of vacuum and ultimately collected in the collector units 56, such articles representing rejects in the processing operation.

What is claimed is:

1. Apparatus for removing the sheath covering from a continuous stream of a composite article having a cohesive filler mass and said sheath covering extending in closely encircling embrace about said filler mass, said apparatus comprising means for advancing the composite article stream along a fixed longitudinal course, means for slitting the sheath longitudinally at a plurality of circularly spaced locations thereon to subdivide said sheath into a corresponding plurality of sheath segments, means for applying suction force to said sheath segments downstream of the location of said slitting means and therewith to draw said segments laterally away from said filler mass, and means for maintaining the advance of said filler along said fixed longitudinal axis while said suction force applying means is drawing said sheath segments away from said mass, said slitting means comprising slitting units disposed at the sides of said continuous stream, said slitting units comprising rotary knives.

2. The apparatus of claim 1 in which said slitting units comprise two in number and are disposed at substantially diametrically opposed locations relative to the continuous stream.

3. Apparatus for removing the sheath covering from a continuous stream of a composite article having a cohesive filler mass and said sheath covering extending in closely encircling embrace about said filler mass, said apparatus comprising means for advancing the composite article stream along a fixed longitudinal course, means for slitting the sheath longitudinally at a plurality of circularly spaced locations thereon to subdivide said sheath into a corresponding plurality of sheath segments, means for applying suction force to said sheath segments downstream of the location of said slitting means and therewith to draw said segments laterally away from said filler mass, and means for maintaining the advance of said filler along said fixed longitudinal axis while said suction force applying means is drawing said sheath segments away from said mass;

said slitting means being operative to slit said sheath covering into two sheath segments, said suction force applying means comprising a pair of rotary wheels having a nip therebetween through which said continuous stream passes, the faces of said wheels being provided with openings communicating with passages formed in said wheels associated with each said opening, a source of vacuum, and means for connecting said source with said passages at least during the time each face opening is at the wheel nip and for a predetermined rotary travel of each said opening beyond said nip, said apparatus further comprising means located adjacent the terminus of the predetermined rotary travel of each opening beyond said nip for applying a flow of air under pressure to said sheath segments to remove same from the faces of said rotary wheels.

4. Apparatus for removing the sheath covering from a continuous stream of a composite article having a cohesive filler means and said sheath covering extending in closely encircling embrace about said filler mass, said apparatus comprising means for advancing the composite article stream along a fixed longitudinal course, means for slitting the sheath longitudinally at a plurality of circularly spaced locations thereon to subdivide said sheath into a corresponding plurality of sheath segments, means for applying suction force to said sheath downstream of the location of said slitting means and therewith to draw said segments laterally away from said filler mass, and means for maintaining the advance of said filler along said fixed longitudinal axis while said suction force applying means is drawing said sheath segments away from said mass said slitting means being operative to slit said sheath covering into two sheath segments, said suction force applying means comprising a pair of rotary wheels having a nip therebetween through which said continuous stream passes, the faces of said wheels being provided with openings communicating with passages formed in said wheels associated with each said opening, a source of vacuum, and means for connecting said source with said passages at least during the time each face opening is at the wheel nip and for a predetermined rotary travel of each said opening beyond said nip, said apparatus further comprising means for removing said sheath covering segments from said rotary wheels operative after each opening has transmitted said predetermined rotary travel, and means for collecting said sheath covering segments upon release of same from said rotary wheels, said collecting means including a source of vacuum, and means defining an enclosure connected to said source of vacuum and having inlet thereto adjacent the locations at which the sheath covering segments are removed from said rotary wheels.

5. Apparatus for removing the sheath covering from a continuous stream of a composite article having a cohesive filler mass and said sheath covering extending in closely encircling embrace about said filler mass, said apparatus comprising means for advancing the composite article stream along a fixed longitudinal course, means for slitting the sheath longitudinally at a plurality of circularly spaced locations thereon to subdivide said sheath into a corresponding plurality of sheath segments, means for applying suction force to said sheath segments downstream of the location of said slitting means and therewith to draw said segments laterally away from said filler mass, and means for maintaining the advance of said filler along said fixed longitudinal axis while said suction force applying means is drawing said sheath segments away from said mass, said slitting means being operative to slit said sheath covering into two sheath segments, said suction force applying means comprising a pair of rotary wheels having a nip therebetween through which said continuous stream passes, the faces of said wheels being provided with openings communicating with passages formed in said wheels associated with each said opening, a source of vacuum, and means for connecting said source with said passages at least during the time each face opening is at the wheel nip and for a predetermined rotary travel of each said opening beyond said nip, said means for maintaining the advance of the filler along said fixed longitudinal axis comprising an elongated catch tube coaxial with said longitudinal axis and having its entry end spaced closely adjacent the nip of said rotary wheels.

* * * * *